US006582893B2

(12) United States Patent
Vincent et al.

(10) Patent No.: US 6,582,893 B2
(45) Date of Patent: Jun. 24, 2003

(54) FERROUS PHOTOGRAPHIC BLEACH-FIXING PRECURSOR COMPOSITIONS AND METHODS FOR THEIR USE

(75) Inventors: Sheridan E. Vincent, Rochester, NY (US); Valerie L. Kuykendall, Penfield, NY (US); Jean M. Buongiorne, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/115,824

(22) Filed: Apr. 3, 2002

(65) Prior Publication Data

US 2002/0164551 A1 Nov. 7, 2002

Related U.S. Application Data

(63) Continuation of application No. 09/723,794, filed on Nov. 28, 2000.

(51) Int. Cl.[7] ..... G03C 7/42; G03C 7/44
(52) U.S. Cl. ..... 430/460; 430/393
(58) Field of Search ..... 430/460, 393

(56) References Cited

U.S. PATENT DOCUMENTS

| | | | | |
|---|---|---|---|---|
| 3,634,088 A | | 1/1970 | Cooley | 430/400 |
| 3,700,450 A | | 10/1972 | Cooley | 430/455 |
| 4,033,771 A | | 7/1977 | Borton et al. | 430/460 |
| 4,036,715 A | | 7/1977 | Baden et al. | 204/109 |
| 4,239,851 A | | 12/1980 | Aoki et al. | 430/377 |
| 4,246,333 A | | 1/1981 | Fuseya et al. | 430/219 |
| 4,313,808 A | * | 2/1982 | Idemoto et al. | 430/398 |
| 4,695,533 A | | 9/1987 | Nakayama et al. | 430/558 |
| 4,758,504 A | | 7/1988 | Ohya et al. | 430/567 |
| 4,762,774 A | | 8/1988 | Kishimoto et al. | 430/393 |
| 4,880,730 A | | 11/1989 | Sato et al. | 430/520 |
| 5,019,493 A | | 5/1991 | Sato et al. | 430/553 |
| 5,055,382 A | | 10/1991 | Long et al. | 430/400 |
| 5,057,406 A | | 10/1991 | Usagawa et al. | 430/522 |
| 5,061,608 A | | 10/1991 | Foster et al. | 430/461 |
| 5,153,111 A | * | 10/1992 | Yoshida et al. | 430/444 |
| 5,234,801 A | | 8/1993 | Ishikawa | 430/400 |
| 5,518,871 A | | 5/1996 | Urabe | 430/567 |
| 5,563,028 A | | 10/1996 | Nakamura et al. | 430/522 |
| 5,652,087 A | | 7/1997 | Craver et al. | 430/430 |
| 5,721,092 A | | 2/1998 | Murai et al. | 430/393 |
| 5,776,643 A | | 7/1998 | Hirai | 430/7 |
| 6,096,487 A | | 8/2000 | Foster | 430/430 |

FOREIGN PATENT DOCUMENTS

| | | |
|---|---|---|
| DE | 100 13614 A1 | 10/2001 |
| EP | 0 479 262 A1 | 4/1992 |
| GB | 1 371 563 | 10/1974 |
| JP | 5-265159 | 10/1915 |
| JP | 61-117541 | 6/1986 |
| JP | 2-56954 | 3/1991 |
| JP | 7-98490 | 4/1995 |
| JP | 8-29935 | 2/1996 |
| JP | 2681661 | 11/1997 |

OTHER PUBLICATIONS

JP Abstract 63094240.
JP Abstract 2029645.

* cited by examiner

*Primary Examiner*—Hoa Van Le
(74) *Attorney, Agent, or Firm*—J. Lanny Tucker

(57) ABSTRACT

Stable, single-part photographic bleach-fixing "precursor" compositions comprise one or more iron-ligand complexes, one or more thiosulfates as the sole fixing agents, and optionally, a sulfite preservative. At least 50 mol % of the iron in the composition is in the form of Fe(II). This composition can be used directly in photoprocessing, or used as a regenerator when mixed with bleach-fixing overflow to provide a replenishing solution. Because the Fe(II) compounds are precursor bleaching agents, they must be oxidized to Fe(III) for active bleaching prior to or during the photographic processing operations.

24 Claims, 1 Drawing Sheet

FERROUS PHOTOGRAPHIC BLEACH-FIXING PRECURSOR COMPOSITIONS AND METHODS FOR THEIR USE

CROSS-REFERENCE TO RELATED APPLICATION

This is a Continuation of application U.S. Ser. No. 09/723,794 filed Nov. 28, 2000.

FIELD OF THE INVENTION

The present invention relates to a novel single-part photographic bleach-fixing precursor composition that can be used to form a photographic bleach-fixing composition that, in turn, can be used for photoprocessing of photographic silver halide materials. In particular, this invention relates to a single-part bleach-fixing precursor composition comprising predominantly ferrous-ligand complexes. This invention also relates to various methods of using the precursor composition.

BACKGROUND OF THE INVENTION

The basic process for obtaining color images from exposed color photographic silver halide materials includes several steps of photochemical processing using appropriate photochemical compositions.

Photographic color developing compositions are used to process color photographic materials such as color photographic films and papers to provide the desired dye images early in the photoprocessing method. Such compositions generally contain color developing agents, for example 4-amino-3-methyl-N-(2-methane sulfonamidoethyl)aniline, as reducing agents to react with suitable color forming couplers to form the desired dyes. U.S. Pat. No. 4,892,804 (Vincent et al.) describes conventional color developing compositions that have found considerable commercial success in the photographic industry.

To obtain useful color images, it is usually necessary to remove all of the silver from the photographic element after color development. This is sometimes known as "desilvering". Removal of silver is generally accomplished by oxidizing the metallic silver in what is known as a "bleaching" step using a bleaching agent, and then dissolving the oxidized silver and undeveloped silver halide with a silver "solvent" or fixing agent in what is known as a "fixing" step.

It has become common for the processing of certain photographic elements, notably color photographic papers, to combine the bleaching and fixing operations into a single "bleach-fixing" operation that can be carried out in one or more processing steps. Bleach-fixing is usually carried out using a composition that includes both a photographic bleaching agent and a photographic fixing agent, as described for example in U.S. Pat. No. 4,033,771 (Borton et al.).

The most common bleaching agents for color photographic processing are complexes of ferric [Fe(III)] ion and various organic chelating ligands (such as aminopolycarboxylic acids), of which there are hundreds of possibilities, all with varying photographic bleaching abilities and biodegradability. Common organic chelating ligands used as part of bleaching agents for photographic color film processing include ethylenediaminetetraacetic acid (EDTA), 1,3-propylenediaminetetraacetic acid (PDTA) and nitrilotriacetic acid (NTA).

Also known are bleaching, bleach-fixing compositions, and processing methods that utilize a ferric complex of one or more of several alkyliminodiacetic acids (such as methyliminodiacetic acid or MIDA) that are known to be more biodegradable than other common organic chelating ligands such as EDTA. Other photographic bleaching agents using similar organic chelating ligands are described in U.S. Pat. No. 5,061,608 (Foster et al.) in which the ferric bleaching agent is advantageously combined with specific aliphatic carboxylic acids to reduce dye stains.

Typical photographic fixing agents include thiosulfates, sulfites, thiocyanates, and mixtures thereof that readily solubilize or "dissolve" silver ion in the processed photographic materials, as described for example in U.S. Pat. No. 5,633,124 (Schmittou et al.).

As pointed out in U.S. Pat. No. 5,055,382 (Long et al.), when photographic materials are processed in bleach-fixing steps, the bleach-fixing composition is generally formulated from two or more "parts", each "part" or solution typically containing one or more (but not all) of the photochemicals necessary for the processing reactions. For example, one "part" usually contains the conventional ferric bleaching agent, and another "part" usually contains a thiosulfate fixing agent(s) and a sulfite preservative. These "parts" are sometimes provided together in a photochemical processing "kit". If all of the chemicals are formulated in a single solution, storage stability is reduced or nonexistent since unwanted chemical interactions among components are inevitable. For example, ferric bleaching agents, sulfite preservatives, and thiosulfate fixing agents are inherently reactive, thereby degrading solution effectiveness and storage stability.

It is also often desired in photographic processing to "regenerate" a "seasoned" bleaching or bleach-fixing composition that has been used extensively by adding depleted photochemicals to reconstitute the desired replenisher solution. One way of regenerating such compositions is to mix what is known as a "regenerator" with a portion of the "seasoned" composition to form a replenisher solution that can be added back to the processing vessel. A variety of photographic ferric bleach regenerator compositions are known, for example, for processing color reversal materials as described for example in U.S. Pat. No. 5,652,087 (Craver et al.) and U.S. Pat. No. 5,834,170 (Craver et al.).

Throughout the photographic industry, there is a desire to provide "concentrated" photoprocessing chemicals to reduce handling, transportation and storage costs. A number of successes have been achieved, for example by Eastman Kodak Company, to provide concentrated color developing compositions. The effort directed to providing concentrated bleach-fixing compositions, and especially in a single-part format, has encountered numerous hurdles.

In the form in which they are currently used, it has generally not been feasible to formulate, package, transport and store either working strength or concentrated bleach-fixing compositions in a single-part format. It is to this need in the photographic industry that the present invention is directed.

SUMMARY OF THE INVENTION

The problems described above have been overcome with a single-part photographic bleach-fixing precursor composition having a pH of from about 4 to about 10 and comprising:

at least 0.05 mol/l of one or more iron-ligand complexes, at least 0.15 mol/l of one or more thiosulfates as the sole photographic fixing agents, and optionally, one or more sulfites, provided that at least 50 mol % of the iron present in the concentrated composition is in the form of Fe(II).

Further, this invention provides a method of providing a color photographic image comprising:

A) color developing an imagewise exposed color photographic silver halide material, B) contacting the color developed color photographic silver halide material with a bleach-fixing solution for sufficient time to remove at least 95% of the silver in the color developed color photographic silver halide material, and C) replenishing the bleach-fixing solution by adding to it a bleach-fixing replenisher solution prepared by mixing:

overflow from the bleach-fixing solution or water, and the single-part photographic bleach-fixing precursor composition described above, wherein the mixed volume ratio of the overflow or water to the single-part photographic bleach-fixing precursor composition is from about 50:1 to about 1:1.

This invention further provides a method of regenerating a spent bleach-fixing solution comprising mixing:

a seasoned bleach-fixing solution, and the single-part, concentrated photographic bleach-fixing precursor composition described above, wherein the mixed volume ratio of the seasoned bleach-fixing solution to the single-part photographic bleach-fixing precursor composition is from about 50:1 to about 1:1.

Still further, a method of providing a color image comprises contacting an imagewise exposed, color developed color photographic silver halide material with the single-part bleach-fixing precursor composition described above, diluted or undiluted, provided that prior to or during the contact, a sufficient amount of Fe (II) in the bleach-fixing precursor composition is oxidized to Fe (III) to bleach the imagewise exposed, color developed color photographic silver halide material.

In addition, the present invention provides a photographic processing kit comprising:

a) the single-part photographic bleach-fixing precursor composition described, and b) either a composition comprising a Fe(III)-ligand complex, a composition comprising a ferrous ion oxidant, or both compositions.

Alternatively, the photographic processing kit comprises:

a) the single-part photographic bleach-fixing precursor composition described above, and b) one or more additional photographic processing compositions.

For example, one useful photographic processing kit of this invention is a single-use processing kit that comprises at least the following multiple photographic photoprocessing liquid concentrates, each concentrate having a volume designed for dilution to the same predetermined volume of working strength photographic processing solution:

a) the single-part photographic bleach-fixing precursor composition described above, b) single-part or two-part photographic color developing concentrate compositions, c) a single-part photographic final rinsing or stabilizing concentrate composition, and optionally, d) a single-part composition comprising a Fe(III)-ligand complex, a composition comprising a ferrous ion oxidant, or both compositions.

The present invention provides a considerable advance in the photoprocessing art by providing a composition that can be used to provide a bleach-fixing composition, that is stable for long-term storage, that is in a single-part format, and can be in concentrated form. Unwanted chemical interactions are critically minimized for these advantages to be achieved.

These desired benefits are obtained by using predominantly ferrous [Fe(II)] compounds in the precursor composition of this invention. By "predominantly" is meant that more than 50 mol % of all iron in the composition is in the form of Fe(II). Preferably, at least 65 mol % of all iron in the composition is in the form of Fe(II), and more preferably from about 70 to 100 mol % of all iron in the composition is in the form of Fe(II).

By "precursor composition" is meant that the composition of this invention is not generally a useful bleach-fixing composition itself, but upon oxidation of sufficient amounts of the Fe(II) ions to Fe(III) ions, the composition can then converted into a useful bleach-fixing composition. Thus, a bleach-fixing composition can be "generated" from the precursor composition of this invention with appropriate oxidation of the ferrous ions. The precursor composition is stable since the Fe(II) compounds and other active photochemicals therein do not adversely interact. However, when the composition is to be used in the various methods described herein, Fe(II) ions can be oxidized to Fe(III) ions in any suitable and convenient manner.

The bleach-fixing precursor compositions of this invention can be provided in photoprocessing kits along with other useful processing compositions or oxidant compositions. In one embodiment, the photographic processing kit comprises compositions that are designed for "single-use", that is the kit solutions are designed for processing one or more photographic materials and then being discarded. All of the concentrate compositions in this kit have quality chemical formulations at volumes such that when each composition is diluted to the same predetermined volume, the results are ready-to-use working strength solutions. Thus, all of the chemical compositions are readily scaleable to useful volumes at the desired dilution rates.

DETAILED DESCRIPTION OF THE INVENTION

Figure 1:
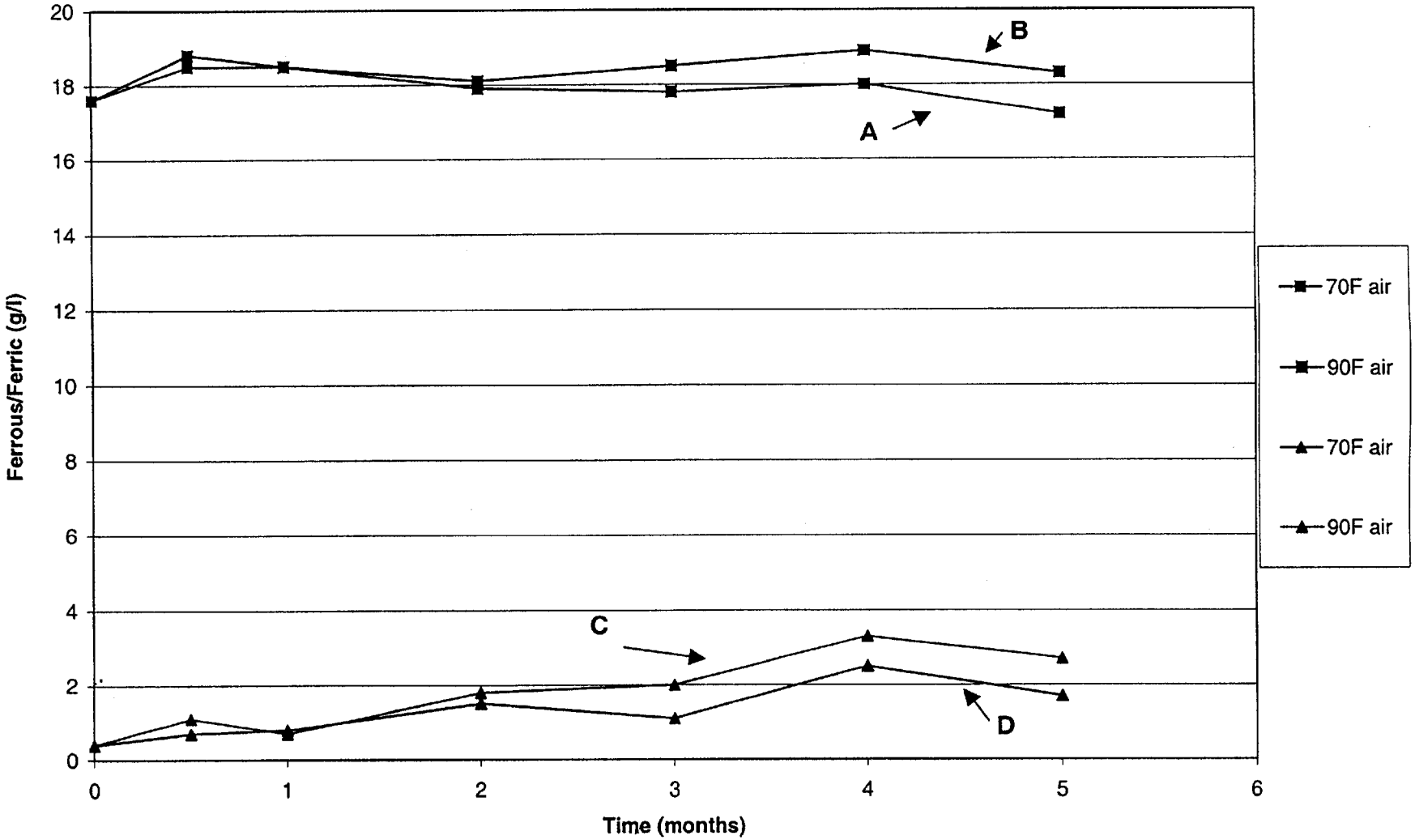
FIG. 1 is a graphical representation of composition stability data (ferrous/ferric ion concentration vs. time) provided for Example 1 below.

Photographic bleach-fixing is carried out in one or more steps using one or more photographic bleaching agents that are Fe(III) complexes of one or more aminopolycarboxylic acid or polycarboxylic acid chelating ligands. At least one of those steps is carried out using a bleach-fixing composition that is generated from the precursor composition of this invention. That precursor composition comprises essential Fe(II)-ligand "precursor" complexes.

In the following discussion, iron-ligand complexed compounds will be referred to as "iron complexes" with the understanding that in the precursor compositions of this invention, they are present predominantly as Fe(II) complexes but in bleach-fixing compositions derived therefrom, they are present predominantly as Fe(III) complexes.

Useful iron complexes comprise one or more polycarboxylic acid chelating ligands. Particularly useful chelating ligands include conventional polyaminopolycarboxylic acids including ethylenedianinetetraacetic acid and others described in *Research Disclosure*, publication 38957, pages 592–639 (September 1996), U.S. Pat. No. 5,582,958 (Buchanan et al.), and U.S. Pat. No. 5,753,423 (Buongiorne et al.). *Research Disclosure* is a publication of Kenneth Mason Publications Ltd., Dudley House, 12 North Street, Emsworth, Hampshire PO10 7DQ England. This reference will be referred to hereinafter as "*Research Disclosure*." There are hundreds of possible chelating ligands that are known in the art, the most common ones being ethylenediaminetetraacetic acid (EDTA), 3-propylenediaminetetraacetic acid (PDTA), diethylenetriaminepentaacetic acid (DTPA), cyclohexanediaminetetraacetic acid (CDTA) and hydroxyethylethylenediaminetriacetic acid (HEDTA).

Biodegradable chelating ligands are particularly desirable in order to minimize the impact on the environment from discharged photoprocessing solutions.

One particularly useful biodegradable chelating ligand is ethylenediaminedisuccinic acid (EDDS) as described in U.S. Pat. No. 5,679,501 (Seki et al.) and EP-0 532,001B (Kuse et al.). All isomers of EDDS are useful, including the [S,S] isomer, and the isomers can be used singly or in mixtures. The [S,S] isomer is most preferred in the iron-EDDS complexes. Other useful disuccinic acid chelating ligands are described in U.S. Pat. No. 5,691,120 (Wilson et al.).

Aminomonosuccinic acids (or salts thereof) are chelating ligands having at least one nitrogen atom to which a succinic acid (or salt) group is attached. These chelating ligands are also useful in iron complexes. U.S. Pat. No. 5,652,085 (Stickland et al.) also provides more details about such chelating ligands, particularly the polyamino monosuccinic acids. Ethylenediamine monosuccinic acid (EDMS) is preferred in this class of chelating ligands.

Other classes of biodegradable aminopolycarboxylic acid or polycarboxylic acid chelating ligands that can be used to form biodegradable iron complexes include iminodiacetic acid and its derivatives (or salts thereof), including alkyliminodiacetic acids that have a substituted or unsubstituted alkyl group having 1 to 6 carbon atoms (such as methyl, ethyl, n-propyl, isopropyl and t-butyl) as described in EP-A-0 532,003 (Kuse et al.). Particularly useful alkyliminodiacetic acids are methyliminodiacetic acid (MIDA) and ethyliminodiacetic acid (EIDA), and MIDA is the most preferred.

All chelating ligands useful in this invention can be present in the free acid form or as alkali metal (for example, sodium and potassium) or ammonium salts, or as mixtures thereof.

Still other biodegradable chelating ligands can be represented by the following Structure I:

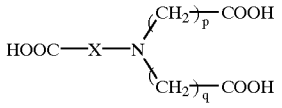

I wherein p and q are independently 1, 2 and 3, and preferably each is 1. The linking group X may be any divalent group that does not bind ferric ion and does not cause the resulting ligand to be water-insoluble. Preferably, X is a substituted or unsubstituted alkylene group, substituted or unsubstituted arylene group, substituted or unsubstituted arylenealkylene group, or substituted or unsubstituted alkylenearylene group.

The iron complexes useful in this invention can be binary complexes (meaning iron is complexed to one or more molecules of a single chelating ligand) or ternary complexes in which iron is complexed to molecules of two distinct chelating ligands similar to iron complexes described for example in U.S. Pat. No. 5,670,305 (Gordon et al.) and U.S. Pat. No. 5,582,958 (noted above). A mixture of multiple binary or ternary iron complexes also can be present in the compositions.

Still other useful biodegradable iron chelating ligands include but are not limited to, alaninediacetic acid, β-alaninediacetic acid (ADA), nitrilotriacetic acid (NTA), glycinesuccinic acid (GSA), 2-pyridylmethyliminodiacetic acid (PMIDA), citric acid, and tartaric acid.

As used herein, the terms "biodegradable" and "biodegradability" refer to at least 80% decomposition in the standard test protocol specified by the Organization for Economic Cooperation and Development (OECD), OECD 301B "Ready Biodegradability: Modified Sturm Test" which is well known in the photographic processing art.

Generally, the one or more iron complexes are present in the concentrated precursor compositions of this invention in an amount of at least 0.05 mol/l, up to 3 mol/l, and preferably in an amount of from about 0.15 to about 0.75 mol/l.

The ferrous salts used to provide bleaching agent precursor compounds in the practice of this invention are generally ferrous ion salts that provide a suitable amount of ferrous ion for complexation with the chelating ligands defined above. Useful ferrous salts include, but are not limited to, ferrous ammonium sulfate, ferrous sodium sulfate, ferrous chloride, ferrous bromide, ferrous sulfate, ferrous acetate, ferrous oxalate, ferrous gluconate, and iron oxide. Ferrous sulfate is a preferred ferrous salt. These salts can be provided in any suitable form, including various hydrated forms where they exist, and are available from a number of commercial sources. The heptahydrate form of ferrous sulfate is one more preferred source of ferrous ions.

The bleaching agent precursor compounds are generally provided by mixing one or more ferrous ion salts (as described above) with the desired chelating ligands in an aqueous solution. The pH of the solution is adjusted using appropriate acids or bases.

It is not necessary that the ferrous ion and the chelating ligand(s) be present in the precursor compositions of this invention in stoichiometric proportions. It is preferred, however, that the molar ratio of the total chelating ligands to ferrous ion be from about 1:1 to about 5:1. In a more preferred embodiment, the ratio is about 1:1 to about 2.5:1 moles of total chelating ligands per mole of ferrous ion.

Generally speaking, ferrous ions are present in the bleach-fixing precursor compositions in an amount of at least 0.05 mol/l, and preferably in an amount of at least 0.15 mol/l.

As noted above, more than 50 mol % of the iron present in the bleach-fixing precursor compositions of this invention is in the Fe(II) form. Thus, up to and almost half of the iron may be present in the Fe(III) form. However, it is preferred that the amount of ferric ion be limited since there may be some natural oxidation of ferrous ion to ferric ion during manufacture and storage of the compositions. As the amount of mol % of Fe(II) is increased compared to Fe(III), the precursor compositions have increased storage stability.

Chloride, bromide or iodide ions, or mixtures of halides are optionally present in the bleach-fixing precursor compositions of this invention. Such ions are provided in the form of water-soluble salts including ammonium, alkali metal and alkaline earth metal salts. The preferred salts are sodium, potassium and ammonium salts.

It is desired that ammonium ions are the predominant ions in the compositions of this invention. That is, ammonium ions comprise at least 50 mol % of the total cations in the compositions.

Buffers are also preferably present in the bleach-fixing precursor compositions of this invention in an amount of at least 0.05 mol/l and generally up to 5 mol/l. Useful buffers include but are not limited to, acetic acid, propionic acid, succinic acid, glycolic acid, benzoic acid, maleic acid, malonic acid, tartaric acid, and other water-soluble aliphatic or aromatic carboxylic acids known in the art. Acetic acid and succinic acid are preferred. Succinic acid is more preferred for odor control. Even more preferred buffers are the odorless acids such as succinic acid so the composition of this invention is as odorless as possible. Inorganic buffers, such as borates, hydrobromic acid, sulfites, and carbonates can be used if desired. A mixture of buffers can be used if desired. The bleach-fixing precursor compositions are preferably aqueous solutions having a pH of from about 4 to about 10. A preferred pH is in the range of from about 4.5 to about 8.

Alternatively, the compositions of this invention can be formulated as solid materials in the form of dry powders, granules or tablets that upon dissolution in water form solutions having the desired pH. Slurries or two-phase compositions are also contemplated as embodiments of this invention. Preferably, however, the single-part concentrated compositions of this invention are substantially single-phase and homogeneous, that is they have minimal if no solid material and have a uniform consistency and composition throughout.

The single-part photographic bleach-fixing precursor compositions of this invention include one or more thiosulfate fixing agents as essential components. The fixing agents can be present as thiosulfate salts (that is alkali metal or ammonium salts) as is well known in the art. Fixing accelerators can also be present and include but are not limited to, thioethers, thiocyanates, thiodiazoles, and mercaptotriazoles.

A third essential component of the bleach-fixing precursor compositions of this invention is one or more inorganic sulfites or bisulfites that provide sulfite ions. Such compounds include but are not limited to sodium sulfite, potassium sulfite, sodium bisulfite, sodium metabisulfite, ammonium sulfite, and ammonium bisulfite. Sodium metabisulfite and ammonium bisulfite are preferred. The sulfite can act as a preservative for the thiosulfate fixing agents.

The bleach-fixing precursor compositions of this invention can also include other addenda that are commonly used in either working strength or concentrated bleach-fixing solutions, replenishers or regenerators including but not limited to, optical brighteners, whitening agents, organic or inorganic preservatives or antioxidants (such as hydroxylamines and sulfinic acids), water-soluble or -dispersible solvents (such as alcohols and glycols), metal sequestering agents, anti-scumming agents, biocides, anti-fungal agents, and anti-foaming agents.

The following TABLE I shows the general and preferred amounts of the two essential and one optional (but preferred) components of the single-part bleach-fixing precursor compositions of this invention. The preferred ranges are listed in parentheses ( ), and all of the ranges are considered to be approximate or "about" in the upper and lower end points. During bleach-fixing, the actual concentrations can vary depending upon extracted chemicals in the composition, replenishment rates, water losses due to evaporation and carryover from any preceding processing bath and carryover to the next processing bath. Optional components of the compositions may be present in amounts well known by those skilled in the photoprocessing art.

TABLE I

| COMPONENT | CONCENTRATIONS |
|---|---|
| Iron complex(es) | 0.05–2 mol/l (0.15–0.75 mol/l) |
| Thiosulfate fixing agent(s) | 0.15–5 mol/l (0.75–3 mol/l) |
| Sulfite Ion | 0–5 mol/l (0.05–2 mol/l) |

The bleach-fixing precursor compositions of this invention can be formulated in working strength or concentrated form (preferably as a concentrate) by mixing one or more iron salts, one or more thiosulfate fixing agents, and one or more sulfites in an appropriate amount of water. Alternatively, the iron complexes can be formed in-situ in a fixing composition by mixing the iron salts with the chelating ligands within the fixing composition.

Fe(II)-ligand complexes are not active photographic bleaching agents. Thus, when the precursor compositions of this invention are to be used initially, the ferrous ions must be oxidized in some manner to provide active ferric ions. This oxidation can be carried out simply by any suitable aeration technique (for example, solution agitation or bubbling air through the solution) to introduce oxygen. Alternatively, chemical oxidants such as sodium, potassium, or ammonium salts of persulfate or peroxide, or hydrogen peroxide can be added to the composition. These oxidants can be used particularly as "starter" chemicals in a "starter" composition that can be used to make up a "fresh" bleach-fixing composition.

In one embodiment described above, the single-part bleach-fixing precursor composition of this invention can be used as a "regenerator" and combined with overflow seasoned or spent bleach-fixing solution to provide a bleach-fixing replenishing solution for the processing method. In such embodiments, the mixed volume ratio of the overflow solution to the bleach-fixing precursor composition is from about 50:1 to about 1:1, and preferably from about 3:1 to about 15:1. The overflow solution used in this instance generally has at least 65 mol % of the iron present in the form of ferric ions.

Alternatively, the precursor composition of this invention can be mixed with a composition comprising sufficient Fe(III)-ligand complexes in appropriate molar ratios to provide a bleach-fixing replenishing solution.

In still another use, the single-part bleach-fixing precursor composition of this invention can be in concentrated form and for use, it can be diluted from 1 to 50 times with water or a suitable buffer to provide a working strength precursor composition. The Fe(II) ions in this composition can be oxidized to Fe(III) ions as noted above and used in any suitable manner.

Preferred embodiments of this invention comprise a single-part photographic bleach-fixing precursor composition having a pH of from about 4.5 to about 8 and comprising:

from about 0.15 to about 0.75 mol/l of one or more iron-ligand complexes, the iron-ligand complexes comprising a ligand selected from the group consisting of ethylenediaminetetraacetic acid, propylenediaminetetraacetic acid, ethylenediaminedisuccinic acid, methyliminodiacetic acid, alaninediacetic acid, nitrilotriacetic acid, ethylenediaminemonosuccinic acid, 2,6-pyridinedicarboxylic acid, and salts thereof, from about 0.75 to about 3 mol/l of ammonium thiosulfate, potassium thiosulfate, or sodium thiosulfate (or mixtures thereof) as the sole photographic fixing agent, and from about 0.05 to about 2 mol/l of one or more sulfites as the sole preservatives for the thiosulfate, from about 0.1 to about 1 mol/l of acetic acid, succinic acid, glycolic acid, maleic acid, propionic acid, malic acid, benzoic acid, or a mixture of two or more of these acids as buffers, provided from about 70 to 100 mol % of the iron present in the composition is in the form of Fe(II).

Color developing compositions are generally used prior to "desilvering" using the bleach-fixing precursor compositions of this invention. Color developing compositions generally include one or more color developing agents that are well known in the art that, in oxidized form, will react with dye forming color couplers in the processed materials. Such color developing agents include, but are not limited to, aminophenols, p-phenylenediamines (especially N,N-dialkyl-p-phenylenediamines) and others which are well known in the art, such as described in U.S. Pat. No. 4,876,174 (Ishikawa et al.), U.S. Pat. No. 5,354,646 (Kobayashi et al.) and U.S. Pat. No. 5,660,974 (Marrese et al.), EP 0 434 097A1 (published Jun. 26, 1991) and EP 0 530 921A1 (published Mar. 10, 1993). It may be useful for the color developing agents to have one or more water-solubilizing groups as are known in the art. Further details of such materials are provided in *Research Disclosure*, noted above.

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-β-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylenediamine sesquisulfate, and others readily apparent to one skilled in the art.

In order to protect the color developing agents from oxidation, one or more antioxidants are generally included in the color developing compositions. Either inorganic or organic antioxidants can be used. Many classes of useful anti oxidants are known, including but not limited to sulfites (such as sodium sulfite, potassium sulfite, sodium bisulfite and potassium metabisulfite), hydroxylamine (and derivatives thereof), hydrazines, hydrazides, amino acids, ascorbic acid (and derivatives thereof), hydroxamic acids, aminoketones, mono- and polysaccharides, mono- and polyamines, quaternary ammonium salts, nitroxy radicals, alcohols, and oximes. Also useful as antioxidants are 1,4-cyclohexadiones as described in U.S. Pat. No. 6,077,653 (McGarry et al.). Mixtures of compounds from the same or different classes of antioxidants can also be used if desired.

Especially useful antioxidants are hydroxylamine derivatives as described for example, in U.S. Pat. No. 4,892,804, U.S. Pat. No. 4,876,174, U.S. Pat. No. 5,354,646, and U.S. Pat. No. 5,660,974, all noted above, and U.S. Pat. No. 5,646,327 (Burns et al.), the disclosures of which are all incorporated herein by reference. Many of these antioxidants are mono- and dialkylhydroxylamines having one or more substituents on one or both alkyl groups. Particularly useful alkyl substituents include sulfo, carboxy, amino, sulfonamido, carbonamido, hydroxy and other solubilizing substituents.

More preferably, the noted hydroxylamine derivatives can be mono- or dialkylhydroxylamines having one or more hydroxy substituents on the one or more alkyl groups. Representative compounds of this type are described for example in U.S. Pat. No. 5,709,982 (Marrese et al.). Specific di-substituted hydroxylamine antioxidants include, but are not limited to: N,N-bis(2,3-dihydroxypropyl) hydroxylamine, N,N-bis(2-methyl-2,3-dihydroxypropyl) hydroxylamine and N,N-bis(1-hydroxymethyl-2-hydroxy-3-phenylpropyl)hydroxylamine. The first compound is preferred.

Many of the noted antioxidants (organic or inorganic) are either commercially available or prepared using starting materials and procedures described in the references noted above in describing hydroxylamines.

Buffering agents are generally present in the color developing compositions to provide or maintain desired alkaline pH of from about 7 to about 13, and preferably from about 8 to about 12. These buffering agents must be soluble in the organic solvent described herein and have a pKa of from about 9 to about 13. Such useful buffering agents include, but are not limited to carbonates, borates, tetraborates, glycine salts, triethanolamine, diethanolamine, phosphates and hydroxybenzoates. Alkali metal carbonates (such as sodium carbonate, sodium bicarbonate and potassium carbonate) are preferred. Mixtures of buffering agents can be used if desired.

In addition to buffering agents, pH can also be raised or lowered to a desired value using one or more acids or bases. It may be particularly desirable to raise the pH by adding a base, such as a hydroxide (for example sodium hydroxide or potassium hydroxide).

The color developing compositions can also include one or more of a variety of other addenda that are commonly used in color developing compositions, including alkali metal halides (such as potassium chloride, potassium bromide, sodium bromide and sodium iodide), metal sequestering compositions (such as polycarboxylic or aminopolycarboxylic acids or polyphosphonates with or without lithium, magnesium or other small cations), auxiliary co-developing agents (such as phenidone type compounds particularly for black and white developing compositions), antifoggants, development accelerators, optical brighteners (such as triazinylstilbene compounds), wetting agents, fragrances, stain reducing agents, surfactants, defoaming agents, and water-soluble or water-dispersible color couplers, as would be readily understood by one skilled in the art [see for example, *Research Disclosure*, noted above]. The amounts of such additives are well known in the art also.

Bleach-fixing compositions generated from the bleach-fixing precursor compositions of this invention have utility to desilver any imagewise exposed, color developed color photographic silver halide element comprising a support and one or more silver halide emulsion layers. A wide variety of types of photographic elements (both color negative and color reversal films and papers, and color motion picture films and prints) containing various types of emulsions can be processed using the present invention, the types of elements being well known in the art (see *Research Disclosure*, noted above). In particular, the invention can be used to process color photographic papers of all types of emulsions including so-called "high chloride" and "low chloride" type emulsions, and so-called "tabular" grain emulsions as well.

The photographic elements processed in the practice of this invention can be single or multilayer color elements. Multilayer color elements typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be included on the backside of conventional supports.

Considerably more details of the element structure and components, and suitable methods of processing various types of elements are described in *Research Disclosure*, noted above. Included within such teachings in the art is the use of various classes of cyan, yellow and magenta color couplers that can be used with the present invention (including pyrazolone and pyrazolotriazole type magenta dye forming couplers.

Examples of commercial color reversal films that can be processed using the present invention include, but are not limited to, EKTACHROME and KODACHROME Color Reversal Films (Eastman Kodak Company), FUJICHROME Color Reversal Films (Fuji Photo Film Co., Ltd.), AGFACHROME Color Reversal Films (AGFA), KONICACHROME Color Reversal Films (Konica) and SCOTCHCHROME Color Reversal Films (Imation).

Examples of commercial color negative films that can be processed using the present invention include, but are not limited to KODAK ROYAL GOLD Color Films (especially the 1000 speed color film), KODAK GOLD MAX Color Films, KODAK ADVANTIX Color Films, KODAK VERICOLOR III Color Films, KONICA VX400 Color Film, KONICA Super SR400 Color Film, FUJI SUPER Color Films, and LUCKY Color Films.

The present invention is particularly useful to process high chloride (greater than 70 mole % chloride and preferably greater than 90 mole % chloride, based on total silver) emulsions in color photographic papers. Such color photographic papers can have any useful amount of silver coated in the one or more emulsions layers, and in some embodiments, low silver (that is, less than about 0.8 g siiver/$m^2$) elements are processed with the present invention. The layers of the photographic elements can have any useful binder material or vehicle as it known in the art, including various gelatins and other colloidal materials.).

Some examples of commercial color papers that can be processed using the present invention include, but are not limited to KODAK EKTACOLOR EDGE 5, 7 and 8 Color Papers (Eastman Kodak Company), KODAK ROYAL VII Color Papers (Eastman Kodak Company), KODAK PORTRA III, IIIM Color Papers (Eastman Kodak Company), KODAK SUPRA III and IIIM Color Papers (Eastman Kodak Company), KODAK ULTRA III Color Papers (Eastman Kodak Company), FUJI SUPER Color Papers (Fuji Photo Co., FA5, FA7 and FA9), FUJI CRYSTAL ARCHIVE and Type C Color Papers (Fuji Photo Co.), KONICA COLOR QA Color Papers (Konica, Type QA6E and QA7), and AGFA TYPE II and PRESTIGE Color Papers (AGFA). The compositions and constructions of such commercial color photographic elements would be readily determined by one skilled in the art.

KODAK DURATRANS, KODAK DURACLEAR, KODAK EKTAMAX RAL and KODAK DURAFLEX photographic materials and KODAK Digital Paper Type 2976 can also be processed using the present invention.

Processing of an imagewise exposed photographic silver halide element is carried out by contacting the element with a color developing composition under suitable time and temperature conditions, in suitable processing equipment, to produce the desired developed image. Additional processing steps can then be carried out using a bleach-fixing composition derived from the compositions of this invention. Bleach-fixing and additional processing steps can be carried out using conventional times and temperatures. Various rinsing and/or stabilizing and drying steps can also be used as would be known in the art. Useful processing steps, conditions and materials useful therefor are well known for the various processing protocols including the conventional Process C-41 processing of color negative films, Process RA-4 for processing color papers and Process E-6 for processing color reversal films (see for example, *Research Disclosure*, noted above).

Bleach-fixing compositions generated from the bleach-fixing precursor compositions of this invention can be used prior to or following conventional bleaching and fixing steps, or conventional bleach-fixing steps in which conventional ferric ion-ligand complexes are used for bleaching. For example, the following processing sequences are representative of methods of this invention (but the invention is not considered to be limited thereby) wherein the bleach-fixing composition derived from the bleach-fixing precursor composition of this invention is used in the step identified by * ("washing" can also be "rinsing" or "dye stabilizing"):

(1) Color development→Bleach-fixing*→Washing (2) Color development→Bleaching→Bleach-fixing*→Washing (3) Color development→Bleach-fixing*→Bleach-fixing→Washing (4) Color development→Bleach-fixing→Bleach-fixing*→Washing (5) Color development→Acid stop→Bleaching→Bleach-fixing*→Washing (6) Black-and-white development→Reversal bath→Color development→Prebleaching→Bleach-fixing*→Washing (7) Color development→Fixing→Bleach-fixing*→Washing The compositions of this invention can also be used in what are known as redox amplification processes, as described for example, in U.S. Pat. No. 5,723,268 (Fyson) and U.S. Pat. No. 5,702,873 (Twist).

Processing according to the present invention can be carried out using conventional deep tanks holding processing solutions. Alternatively, it can be carried out using what is known in the art as "low volume thin tank" processing systems, or LVTT, which have either a rack and tank or automatic tray design. Such processing methods and equipment are described, for example, in U.S. Pat. No. 5,436,118 (Carli et al.) and publications noted therein.

The single-part concentrated bleach-fixing precursor compositions of this invention can be used to provide working tank solutions or replenishers, and can be in diluted or concentrated form for use as a regenerator and/or replenisher. A bleach-fixing composition prepared therefrom can be replenished at a replenishment rate of as low as 10 ml/$m^2$ and up to 1000 ml/$m^2$. Replenishment can be accomplished directly into the processing tank, or as noted above, a portion of overflow solution can be mixed with the bleach-fixing precursor composition as a regenerator to provide a suitable regenerated replenisher solution. The concentrated precursor composition can also be delivered directly to the processing tank.

The processing time and temperature used for each processing step of the present invention are generally those conventionally used in the art. For example, color development is generally carried out at a temperature of from about 20 to about 60° C. The overall color development time can be up to 4 minutes, and preferably from about 25 to about 450 seconds. The shorter overall color development times are desired for processing color photographic papers.

Bleach-fixing according to this invention can be carried out in less than 8 minutes. For example, the time may be within 5 minutes, and more preferably within 2 minutes. For processing most color papers, bleach-fixing may be as short as 10 seconds. In all methods, preferably at least 95% of the silver in the processed material is bleached during this bleaching time. Bleaching temperatures are generally from about 20 to about 45° C.

Each of the processing steps can be carried out in one or more tanks or stages arranged in countercurrent or concurrent flow. Any bleach-fixing technique can be used, including immersion of the element in the bleach-fixing composition (with or without agitation or circulation), bringing the element into contact with a web or drum surface that is wet with the bleach-fixing composition, or application of the composition to the element by high velocity jet or spray.

During the bleach-fixing step, the processing bath may accumulate dissolved silver halide, and other substances that are extracted from the processed photographic element. Such materials, and particularly silver halide, can be removed using known means, such as ion exchange, electrolysis, electrodialysis and precipitation.

The single-part bleach-fixing precursor compositions of this invention can be supplied as one component of a photographic processing kit. Such kits can also include a "starter" amount of a composition containing Fe(III)-ligand or ferrous ion oxidant, and/or additional photographic processing compositions such as color developing compositions, bleaching compositions, fixing compositions, rinsing compositions, stabilizing compositions, reversal compositions, and other compositions that would be readily apparent to one skilled in the art. Such kits can include some or all of the processing compositions necessary for providing an image as well as suitable dispensing equipment and instructions in a suitable container or package.

As noted above, the single-part photographic bleach-fixing precursor composition of this invention can be provided in a "ready-to-use" processing kit that is designed for limited use before being discarded. This kit includes one or more single- or multi-part compositions that are provided in concentrated form. These concentrates are then diluted to the same predetermined volume to provide working strength solutions. Useful single- or multi-part concentrated color developing compositions are described for example in U.S. Pat. No. 6,077,651 (Darmon et al.) and U.S. Pat. No. 6,136,518 (Buongiome et al.), both incorporated herein by reference. Single-part photographic final rinsing or stabilizing compositions are described for example in U.S. Pat. No. 5,948,604 (Craver et al.), incorporated herein by reference. Single-part "starter" compositions are described above.

The various components of the "ready-to-use" kit have predetermined volumes such that a particular predetermined dilution rate can be used with each concentrate to provide the same predetermined working strength volume for example of 1, 5 or 15 liters. The various dilution rates would be readily apparent to one skilled in the art.

All of the compositions of the various kits of this invention can be packaged in any suitable manner or container including, but not limited to, glass or plastic bottles, vials, packettes, drums, syringes, or partially or wholly collapsible containers (such as those described in U.S. Pat. No. 5,577,614 of Palmeroni, Jr. et al.).

The following examples are provided to illustrate the practice of this invention and are not meant to be limiting in any manner.

EXAMPLE 1

Preferred Concentrated Ferrous Bleach-Fixing

Precursor Composition

A single-part photographic bleach-fixing precursor composition of this invention was formulated and evaluated for stability in concentrated form. This composition comprised the following components:

| | |
|---|---|
| Water | 346 ml |
| Ammonium hydroxide (28%) | 113 g/l (1.87 mol/l) |
| EDTA | 104 g/l (0.356 mol/l) |
| Sodium metabisulfite | 43.6 g/l (0.230 mol/l) |
| Ferrous sulfate, heptahydrate | 92.7 g/l (0.334 mol/l) |
| Glacial acetic acid | 25.6 g/l (0.427 mol/l) |
| Ammonium thiosulfate | 209.6 g/l (1.32 mol/l) |
| Ammonium sulfite | 14.8 g/l (0.127 mol/l) |
| pH | 5.25 |

This concentrate was tested for low temperature stability by subjecting samples to keeping temperatures of −35° C., −18° C., −7° C., −1° C., +4° C. and +10° C. for two weeks. The samples were observed immediately after removing them from these keeping temperatures, then kept at room temperature for 24 hours and then observed again. All samples except the sample kept at −35° C. were free of precipitates.

The concentrate was also evaluated for high temperature stability in 21° C. and 32° C. controlled temperature and humidity chambers for 5 months. After this time, the concentrate was evaluated for changes in pH, and ferrous, sulfite, and thiosulfate ion concentrations. Each of these parameters was observed to change very little and the sample was considered to be stable. For example, FIG. 1, Curves A and B identify the changes in ferrous ion concentrations at 21° C. and 32° C., respectively, and Curves C and D identify the ferric ion concentrations at 21° C. and 32° C., respectively.

COMPARATIVE EXAMPLE

A conventional two-part bleach-fixing composition, KODAK EKTACOLOR SM Processing Unit P2/RA-2 SM was mixed in the proper proportions to evaluate its stability. Within 24 hours at room temperature, precipitates were observed.

EXAMPLE 2

Another single-part bleach-fixing precursor composition of this invention was prepared in concentrated form by mixing ethylenediaminetetraacetic acid (EDTA, 0.39 mol/l), ferrous sulfate heptahydrate (0.363 mol/l), ammonium thiosulfate (1.52 mol/l), sodium metabisulfite (0.26 mol/l), ammonium sulfite (0.14 mol/l), glacial acetic acid (0.5 mol/l), and ammonium hydroxide (2.1 mol/l). The pH was adjusted with acetic acid or ammonium hydroxide. A replenisher solution was made from this concentrated composition by mixing 400 ml of it with 600 ml of water to yield the following bleach-fixing precursor replenisher composition.

During this mixing process, natural oxidation of ferrous ions to ferric ions was begun.

| Components | Tank Amount | Replenisher Amount |
|---|---|---|
| Ethylenediamine-tetraacetic acid | 28.4 g/l, (0.098 mol/l) | 45.5 g/l (0.156 mol/l) |
| Ammonium hydroxide | 34 ml/l | 45 ml |
| Glacial acetic acid | 7.5 g/l | 12 g/l |
| Ferrous sulfate heptahydrate (98%) | 25.9 g/l (0.09 mol/l) | 41.4 g/l (0.146 mol/l) |
| Sodium metabisulfite | 12.5 g/l (0.066 mol/l) | 20 g/l (0.105 mol/l) |
| Ammonium thiosulfate | 56.5 g/l (0.38 mol/l) | 90.4 g/l (0.610 mol/l) |
| Ammonium sulfite | 4 g/l (0.34 mol/l) | 6.4 g/l (0.55 mol/l) |
| pH Adjusted to: (with acetic acid or ammonium hydroxide) | 5.25–6.4 | 5.25 |
| Water to final volume of: | 1 Liter | 1 Liter |

Mixing the replenisher bleach-fixing precursor solution can be carried out under a blanket of nitrogen, with purging of the solution with nitrogen, or in the absence of added nitrogen.

A working strength tank bleach-fixing precursor solution was prepared from this replenisher composition by addition of 500 ml of the above replenisher bleach-fixing precursor solution to 300 ml of water. Further oxidation of ferrous ions to ferric ions continued during the mixing process.

Samples of various imagewise exposed commercial color photographic silver halide materials (KODAK EKTACOLOR EDGE 7, KODAK EKTACOLOR EDGE 8, KODAK PORTRA III, KODAK SUPRA III, KODAK ULTRA III, KODAK EKTAMAX RAL, FUJI CRYSTAL ARCHIVE, AND KONICA QA7 Color Papers) were processed under the following conditions in an automatic minilab processor. Processing was carried out using the noted ferrous precursor solution described above that was replenished by the replenisher bleach-fixing precursor solution above at 54 ml/m$^2$. The ferrous ions in the precursor solutions were converted to ferric ions by air oxidation.

The photoprocessing sequence was as follows:

| Processing Step | Temperature (° C.) | Time (seconds) | Replenishment Rate (ml/m$^2$) | Capacity of Tank (liters) |
|---|---|---|---|---|
| Color Development* | 37.8 | 45 | 161 | 5.5 |
| Bleach-Fixing | 37.8 | 45 | 54 | 5.6 |
| Stabilizing** | 37.8 | 45 | | 4.5 |
| Stabilizing** | 37.8 | 45 | | 4.4 |
| Stabilizing** | 37.8 | 45 | 248 | 4.4 |

*Color development was carried out using KODAK EKTACOLOR PRIME SP Developer Replenisher.
**Stabilizing was carried out using KODAK EKTACOLOR PRIME Stabilizer & Replenisher.

Performance of the bleach-fixing composition obtained using the present invention was evaluated by comparing its performance to that of a conventional bleach-fixing composition solution having a ferric complex bleaching agent. This "Control" composition was made by mixing 500 ml of KODAK EKTACOLOR PRIME Bleach-Fix Replenisher with to 300 ml of water.

Sensitometric performance after photoprocessing was evaluated by measuring: (1) residual dye stain as measured by an increase in $D_{min}$ density, (2) residual silver remaining in the processing material as measured by IR density at 1000 nm, and (3) leuco dye formation as measured by decrease in $D_{max}$ density.

The data from these tests indicate that the seasoned compositions obtained from the present invention exhibited equivalent sensitometry compared to the Control composition. With the "fresh" solutions, residual dye stain was the same, but higher leuco cyan dye formation was evident in the processed Konica QA-7A and KODAK EDGE 7 Color Papers as evidenced by lower red $D_{max}$ density. Silver was retained in the processed color paper samples examined in the "fresh" solution compared to the Control solution.

EXAMPLE 3

The bleach-fixing replenisher precursor composition (500 ml) described in Example 2 was used mixed with 300 ml of water, and its pH was adjusted to 6.2 with ammonium hydroxide. The various photographic materials were imagewise exposed and processed as described in Example 2. The sensitometric results indicated that the different pH of the precursor tank composition of this invention reduced leuco cyan dye formation in the processed Konica QA-7A and KODAK EDGE 7 Color Papers. Acceptable sensitometry was observed for all color paper samples evaluated in this example.

EXAMPLE 4

The bleach-fixing replenisher precursor composition of Example 2 (500 ml) was mixed with 300 ml of water, and sodium persulfate (43.4 g/l, 40% solution) was added as an iron oxidizing agent. The various photographic materials were imagewise exposed and processed as described in Example 2. The sensitometric results indicated that the oxidizing agent improved bleaching performance in the "fresh" working strength bleach-fixing solution, as evidenced by no retained silver in the processed color paper samples. The resulting bleach-fixing solution also exhibited less propensity for leuco cyan dye formation as evidenced by equivalent red $D_{max}$ density observed in the Konica QA-7A Color Paper samples in comparison to similar samples processed using the Control bleach-fixing composition.

EXAMPLE 5

A single-part bleach-fixing precursor replenisher composition was made having the following components and concentrations:

| Component | Replenisher Amount |
|---|---|
| [S,S]-Ethylenediaminedisuccinic acid | 16.7 g/l (0.057 mol/l) |
| Ethylenediaminetetraacetic acid | 33.4 g/l (0.114 mol/l) |
| Ammonium hydroxide (28% solution) | 56 ml |
| Glacial acetic acid | 19 g/l |
| Ferrous sulfate heptahydrate (98% solution) | 43.6 g/l (0.154 mol/l) |
| Sodium metabisulfite | 13.7 g/l (0.072 mol/l) |
| Ammonium thiosulfate (58% solution) | 210 g/l (0.82 mol/l) |
| Ammonium bisulfite (45% solution) | 10.6 g/l (0.048 mol/l) |
| pH Adjust to: (with acetic acid or ammonium hydroxide) | 4.70 |
| Water to final volume of: | 1 liter |

A working strength bleach-fixing solution was made by addition of 500 ml of the precursor solution described above to 300 ml of water followed by addition of 17.7 g/l of sodium persulfate plus ammonium hydroxide to pH 6.4.

A comparative working-strength bleach-fixing solution was made by addition of 500 ml of KODAK EKTACOLOR PRIME Bleach-Fix and Replenisher solution to 300 ml of water. The sensitometric performance of the working strength bleach-fixing solution was compared to the comparative solution. Both the fresh condition and the bleach fixing solutions that had been seasoned to 63% of the equilibrium position performed similarly to the comparative solution. This demonstrated that ligands other than EDTA, such as EDDS or combinations of ligands, can be used in the bleach-fixing precursor compositions of this invention, since acceptable sensitometry was observed for all color paper samples evaluated in this example.

EXAMPLE 6

This example demonstrates that compounds other than acetic acid can be used as a pH buffer and acid source. The following bleach-fix precursor replenisher solutions were mixed:

| | Replenisher Amount |
|---|---|
| Bleach-Fixing Solution A Components | |
| Ethylenediaminetetraacetic acid | 45.5 g/l (0.156 mol/l) |
| Ammonium hydroxide | 45 ml |
| Succinic acid | 22.6 g/l |
| Ferrous sulfate heptahydrate (98% solution) | 41.4 g/l (0.146 mol/l) |
| Sodium metabisulfite | 20 g/l (0.105 mol/l) |
| Ammonium thiosulfate | 90.4 g/l (0.610 mol/l) |
| Ammonium sulfite | 6.4 g/l (0.55 mol/l) |
| pH Adjust to: (with acetic acid or ammonium hydroxide) | 5.25 |
| Water to final volume of: | 1 liter |
| Bleach-Fixing Solution B Components | |
| Ethylenediaminetetraacetic acid | 45.5 g/l (0.156 mol/l) |
| Ammonium hydroxide | 45 ml |
| Ferrous sulfate heptahydrate (98% solution) | 41.4 g/l (0.146 mol/l) |
| Sodium metabisulfite | 30 g/l (0.158 mol/l) |
| Ammonium thiosulfate | 90.4 g/l (0.610 mol/l) |
| Ammonium sulfite | 6.4 g/l (0.55 mol/l) |
| pH Adjust to: (with acetic acid or ammonium hydroxide) | 5.25 |
| Water to final volume of: | 1 liter |

The working-strength solutions were made by addition of 500 ml replenisher solution to 300 ml water.

A comparative working strength bleach-fixing solution was made by addition of 500 ml of KODAK EKTACOLOR PRIME Bleach-Fix & Replenisher solution to 300 ml of water. The sensitometric performance of the working strength bleach-fixing solution was compared to the comparative solution. Both the fresh condition and the bleach-fixing solutions that had been seasoned to 63% of equilibrium performed similarly to the comparative solution. The pH changes that occurred in each bleach-fixing solution from fresh to 63% equilibrium seasoned state were small.

The invention has been described in detail with particular reference to certain preferred embodiments thereof, but it will be understood that variations and modifications can be effected within the spirit and scope of the invention.

We claim:

1. A single-part photographic bleach-fixing precursor composition having a pH of from about 4 to about 10 and comprising at least 0.05 mol/l of one or more iron-ligand complexes, at least 0.15 mol/l of one or more thiosulfates as the sole photographic fixing agents, and optionally one or more sulfites, provided that over 50 mol % of the iron present in said precursor composition is in the form of Fe(II).

2. The precursor composition of claim 1 having a pH of from about 4.5 to about 8.

3. The precursor composition of claim 1 comprising from about 0.15 to about 0.75 mol/l of one or more iron complexes.

4. The precursor composition of claim 1 comprising at least one iron complex comprising an aminopolycarboxylic acid or polyaminopolycarboxylic acid, or salt thereof.

5. The precursor composition of claim 4 comprising at least one iron complex that comprises a biodegradable aminopolycarboxylic acid or polyaminopolycarboxylic acid, or salt thereof.

6. The precursor composition of claim 1 comprising an iron complex that comprises a ligand selected from the group consisting of ethylenediaminetetraacetic acid, propylenediaminetetraacetic acid, ethylenediaminedisuccinic acid, methyliminodiacetic acid, alaninediacetic acid, nitrilotriacetic acid, ethylenediaminemonosuccinic acid, 2,6-pyridinedicarboxylic acid, and salts thereof.

7. The precursor composition of claim 1 comprising sodium thiosulfate, potassium thiosulfate, ammonium thiosulfate, or mixtures of any of these.

8. The precursor composition of claim 1 wherein more than 50 mol % or the total cations are ammonium ions.

9. The precursor composition of claim 1 wherein said sole photographic thiosulfate fixing agent is present in an amount of from about 0.75 to about 3 mol/l.

10. The precursor composition of claim 1 comprising from about 0.05 to about 2 mol/l of said sulfite.

11. The precursor composition of claim 1 wherein at least 65 mol % of the iron present therein is in the form of Fe(II).

12. The precursor composition of claim 11 wherein from about 70 to 100 mol % of the iron present therein is in the form of Fe(II).

13. The precursor composition of claim 1 further comprising at least 0.1 mol/l of one or more carboxylic acids as buffer(s).

14. The precursor composition of claim 13 comprising acetic acid, succinic acid, glycolic acid, maleic acid, propionic acid, malic acid, benzoic acid, or any mixture of these acids.

15. A single-part, concentrated photographic bleach-fixing precursor composition having a pH of from about 4.5 to about 8 and comprising:

from about 0.15 to about 0.75 mol/l of one or more iron-ligand complexes, said iron complexes comprising a ligand selected from the group consisting of ethylenediaminetetraacetic acid, propylenediaminetetraacetic acid, ethylenediaminedisuccinic acid, methyliminodiacetic acid, alaninediacetic acid, nitrilotriacetic acid, ethylenediaminemonosuccinic acid, 2,6-pyridinedicarboxylic acid, and salts thereof, from about 0.75 to about 3 mol/l of potassium thiosulfate, sodium thiosulfate, or ammonium thiosulfate as the sole photographic fixing agent, from about 0.05 to about 2 mol/l of one or more sulfites, and from about 0.1 to about 1 mol/l of acetic acid, succinic acid, glycolic acid, maleic acid, propionic acid, malic acid, benzoic acid, or any mixture of these acids, provided from about 70 to 100 mol % of the iron present in said composition is in the form of Fe(II).

16. A method of providing a color photographic image comprising:

A) color developing an imagewise exposed color photographic silver halide material, B) contacting said color developed color photographic silver halide material with a bleach-fixing solution for sufficient time to remove at least 95% of the silver in said color developed color photographic silver halide material, and C) replenishing said bleach-fixing solution by adding to it a bleach-fixing replenisher solution prepared by mixing:

overflow from said bleach-fixing solution or water, and a single-part photographic bleach-fixing precursor composition having a pH of from about 4 to about 10 and comprising at least 0.05 mol/l of one or more iron-ligand complexes, at least 0.15 mol/l of one or more thiosulfates as the sole photographic fixing agents, and optionally one or more sulfites, provided more than 50 mol % of the iron present in said precursor composition is in the form of Fe(II), wherein the mixed volume ratio of said overflow or water to said single-part bleach-fixing precursor composition is from about 50:1 to about 1:1.

17. The method of claim 16 wherein the mixed volume ratio of said overflow or water to said single-part photographic bleach-fixing precursor composition is from about 15:1 to about 3:1.

18. The method of claim 16 wherein said photographic silver halide material is a color photographic paper.

19. A method of regenerating a spent bleach-fixing solution comprising mixing:

a spent bleach-fixing solution, and a single-part photographic bleach-fixing precursor composition having a pH of from about 4 to about 10 and comprising at least 0.05 mol/l of one or more iron-ligand complexes, at least 0.15 mol/I of one or more thiosulfates as the sole photographic fixing agents, and optionally one or more sulfites, provided more than 50 mol % of the iron present in said single-part, concentrated photographic bleach-fixing precursor composition is in the form of Fe(II), wherein the mixed volume ratio of said spent bleach-fixing solution to said single-part photographic bleach-fixing precursor composition is from about 50:1 to about 1:1.

20. A method of providing a color image comprising contacting an imagewise exposed, color developed color photographic silver halide material with the single-part photographic bleach-fixing precursor composition of claim 1, diluted or undiluted, provided that prior to or during said contact, sufficient amounts of Fe (II) in said bleach-fixing precursor composition are oxidized to Fe (III) in order to bleach said imagewise exposed, color developed color photographic silver halide material.

21. The method of claim 20 wherein said Fe (II) is oxidized to Fe (III) by addition of an oxidizing agent, aeration, or both.

22. A photographic processing kit comprising:

a) a single-part photographic bleach-fixing precursor composition having a pH of from about 4 to about 10 and comprising:

at least 0.05 mol/l of one or more iron-ligand complexes, at least 0.15 mol/l of one or more thiosulfates as the sole photographic fixing agents, and optionally one or more sulfites, provided more than 50 mol % of the iron present in said single-part photographic bleach-fixing precursor composition is in the form of Fe(II), and b) either a composition comprising a Fe(III)-ligand complex, a composition comprising a ferrous ion oxidant, or both compositions.

23. A photographic processing kit comprising:

a) a single-part photographic bleach-fixing precursor composition having a pH of from about 4 to about 10 and comprising:

at least 0.05 mol/l of one or more iron-ligand complexes, at least 0.15 mol/l of one or more thiosulfates as the sole photographic fixing agents, and optionally mol/l of one or more sulfites as the sole preservatives for said thiosulfate(s), provided more than 50 mol % of the iron present in said single-part, concentrated bleach-fixing precursor composition is in the form of Fe(II), and b) one or more additional photographic processing compositions.

24. A single-use processing kit that comprises at least the following multiple photographic photoprocessing liquid concentrates, each concentrate having a volume designed for dilution to the same predetermined volume of working strength photographic processing solution:

a) a single-part, concentrated photographic bleach-fixing precursor composition having a pH of from about 4 to about 10 and comprising:

at least 0.05 mol/l of one or more iron-ligand complexes, at least 0.15 mol/l of one or more thiosulfates as the sole photographic fixing agents, and optionally, one or more sulfites, provided more than 50 mol % of the iron present in said single-part, concentrated bleach-fixing precursor composition is in the form of Fe(II), b) single-part or two-part photographic color developing concentrate compositions, c) a single-part photographic final rinsing or stabilizing concentrate composition, and optionally, d) a single-part composition comprising a Fe(III)-ligand complex, a composition comprising a ferrous ion oxidant, or both compositions.

* * * * *